US005649570A

United States Patent [19]

Wahhoud et al.

[11] Patent Number: 5,649,570

[45] Date of Patent: Jul. 22, 1997

[54] WEAVING LOOM WITH A COMBINATION OF A WEFT THREAD CUTTING DEVICE AND A SELVAGE LAYING-IN DEVICE

[75] Inventors: Adnan Wahhoud, Lindau-Bodolz; Peter Czura, Wangen, both of Germany

[73] Assignee: Lindauer DORNIER Gesellschaft mbH, Lindau, Germany

[21] Appl. No.: 570,671

[22] Filed: Dec. 11, 1995

[30] Foreign Application Priority Data

Dec. 9, 1994 [DE] Germany ..... 44 43 899.0

[51] Int. Cl.[6] ..... D03D 47/48

[52] U.S. Cl. ..... 139/291 C; 139/188 R; 139/192; 139/291 R; 139/434

[58] Field of Search ..... 139/188 R, 192, 139/291 R, 291 C, 430, 434

[56] References Cited

U.S. PATENT DOCUMENTS 4,951,717 8/1990 Riezler ..... 139/435.1

4,957,144 9/1990 Watanabe et al. ..... 139/434

5,070,912 12/1991 Ludwig ..... 139/188 R

*Primary Examiner*—Andy Falik

*Attorney, Agent, or Firm*—W. G. Fasse; W. F. Fasse

[57] ABSTRACT

A weaving loom for producing at least one woven fabric web (9) with at least one laid-in selvage includes a weft thread cutting device (23) and an associated selvage laying-in device (14). The cutting device and the laying-in device are mounted relative to the loom machine frame so as to be adjustably movable across the width of the loom along a spreader table (11) with its associated spreader devices (10, 12, 26) and then selectively fixed at any desired width-wise position. The cutting device and the associated laying-in device can be arranged to be independently adjustable, or can be mounted on a common support member, so as to be adjustable in common or in unison with each other across the width of the loom.

20 Claims, 4 Drawing Sheets

WEAVING LOOM WITH A COMBINATION OF A WEFT THREAD CUTTING DEVICE AND A SELVAGE LAYING-IN DEVICE

FIELD OF THE INVENTION

The invention relates to a weaving loom for producing one or more webs of woven fabric having at least one laid-in selvage. The loom includes a weft thread cutting device and a selvage laying-in device. After a weft thread is shot or picked through a first shed and is beat-up against the beat-up edge of the woven fabric, the ends of the weft thread are cut off by the cutting device near the edges of the fabric web. Then the cut ends of the weft thread are laid into the subsequently opened shed by the selvage laying-in device to form the fabric selvage.

BACKGROUND INFORMATION

In prior art looms, it has been relatively difficult to switch from one fabric width to another. In other words, it has been difficult to convert the loom for weaving a second, different fabric web width, after the loom has been set up for a first specific width. To carry out such a switch, in each case the respectively provided spreader arrangement and its associated auxiliary components, would have to be exchanged, i.e. replaced with a different spreader arrangement that had been set up for the new weaving width. Next, the two laying-in and cutting devices at the edges of the woven web would have to be dismounted, repositioned and then carefully adjusted for the new weaving width. The total procedure for converting a prior art loom to a new weaving width is thus relatively complicated and time consuming.

OBJECTS OF THE INVENTION

In view of the above it is the aim of the invention to achieve the following objects singly or in combination:

- to provide an improved loom in which the cutting and laying-in devices can easily be adjusted to different weaving widths, without requiring a first spreader table with its associated spreader devices that is suited to a first weaving width to be replaced by a second spreader table with its associated spreader devices that is suited to a second weaving width;
- to provide a loom having a full-width continuous spreader table and spreader rod arrangement, and having a cutting device and a laying-in device that are mounted to be adjustable across the full width of the weaving machine along the spreader arrangement;
- to arrange a weft thread cutting device and a selvage laying-device in a loom in such a manner that the cutting device and the laying-in device are independently adjustable across the width of the loom, and thereby also adjustable relative to each other in a width direction;
- to arrange a weft thread cutting device and a selvage laying-in device on a common support member that can be adjusted across the width of the loom, whereby the cutting device and the laying-in device can be easily positioned in unison to a proper width-wise position in one simple adjustment; and
- to arrange a cutting device and a laying-in device so as to provide a coarse adjustment and a fine adjustment of the position thereof relative to the laid-in selvage, and/or relative to each other.

SUMMARY OF THE INVENTION

The above objects have been achieved in a weaving loom according to the present invention in which the cutting device and the laying-in device are arranged to be adjustable across the weaving width, along a spreader table with its associated spreader devices that corresponds to the rated weaving width of the loom. In a first embodiment, the cutting device and the laying-in device together form a separate, integral structural component that may be translated or slidingly moved as a unit across the weaving width along a support rail member of the loom. For example, the cutting device and the laying-in device may both be mounted on a single common support bracket. The integral structural component, which includes the cutting device, the laying-in device and the support bracket, reaches over the spreader table above the spreader arrangement and toward the weaving reed to position the cutting device and the laying-device into proper positions for forming the laid-in selvage of the fabric.

In a second embodiment, the cutting device and the laying-in device are each independently mounted to be independently positionable across the weaving width and along the spreader table. For example, two support brackets can be provided respectively, to slidably adjustably mount the cutting device and the laying-in device to a support rail member of the loom machine frame. In this case, the cutting device reaches over the spreader table, above the spreader devices and toward the weaving reed, and the support bracket of the laying-in device reaches under the spreader table, to position the cutter device and the laying-device properly for forming the laid-in selvage.

The cutting device preferably includes a fixed blade and a moveable blade that is driven through a linkage by a motor. Adjustment elements, such as bolts in slotted holes, are preferably provided to allow the position of the laying-in device relative to the blades of the cutting device to be adjusted in any direction as necessary.

It is an essential feature of the present invention that the cutting device together with its associated laying-in device can be adjusted in its position across the width of the loom along the continuous or through-going spreader table or spreader rod arrangement. The present invention achieves the considerable advantage over the prior art, that it is no longer necessary to exchange or replace the entire spreader arrangement including the spreader table in order to switch from one weaving width to a different weaving width. Instead, in the loom of the invention, the cutting device and its associated laying-in device can simply be slidingly moved, i.e. adjusted in position across the width of the loom. Thus, it is no longer necessary to disassemble and remove the spreader table and the spreader devices. These advantages are achieved by the invention in both air-jet looms as well as gripper or rapier looms, especially when the laying-in devices are pneumatically operated devices.

The first embodiment described above achieves the advantage that simply a single adjustment is necessary to properly position both the cutting device and the laying-in device, because the desired relative position of the laying-in device and the cutting device is maintained constant due to their common mounting on a single support member.

In the second embodiment, the laying-device and the cutting device are arranged independently of one another and adjustably relative to one another. This arrangement achieves the advantage that the selvage laying-in depth along the edge of the woven fabric can be easily adjusted.

It is a common feature of both embodiments that a coarse adjustment to the approximate weaving width of the desired fabric as well as a fine adjustment of the laying-in device relative to the cutting device is possible. This feature of the invention allows a quick and exact positioning adjustment of the cutting device and of the laying-in device relative to the laid-in selvage that is to be formed along the edge of the woven fabric.

According to a further detail of the above embodiments, the laying-in device may be rigidly attached to the fixed blade of the cutting device. The moving blade of the cutting device, which is driven by the associated motor of the cutting device, is pivotally or articulately connected to the fixed blade.

The present inventive arrangement is not only applicable to a loom for weaving only a single fabric web. Instead, the invention is also applicable to producing several woven webs next to one another, as long as the loom has a sufficient total width. The present special arrangement and adjustability of the cutting devices and laying-in devices especially improves the ease of readjusting the loom components for weaving several fabric webs of different widths.

There are several possible embodiments of the spreader table itself. In a first embodiment, a substantially cylindrical spreader rod is arranged between the spreader table and the spreader lid or cover. Thus, the spreader cover and the spreader rod together form the spreader device. In a second embodiment, a so-called needle spreader is arranged essentially between two spreader members that are attached to the spreader table, whereby the needle spreader reaches into or engages the finished woven fabric web.

Auxiliary reeds may be provided to fill gaps in the main reed that accommodate the laying-in devices when the reed beats up the weft thread. In order to minimize the mass of the total weaving reed arrangement, the fixed auxiliary weaving reed is preferably connected directly to the support member of the laying-in device. Also, such an arrangement further simplifies the necessary adjustments for switching the loom to a different weaving width, because the auxiliary reed will be automatically properly repositioned as the laying-in device is repositioned.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
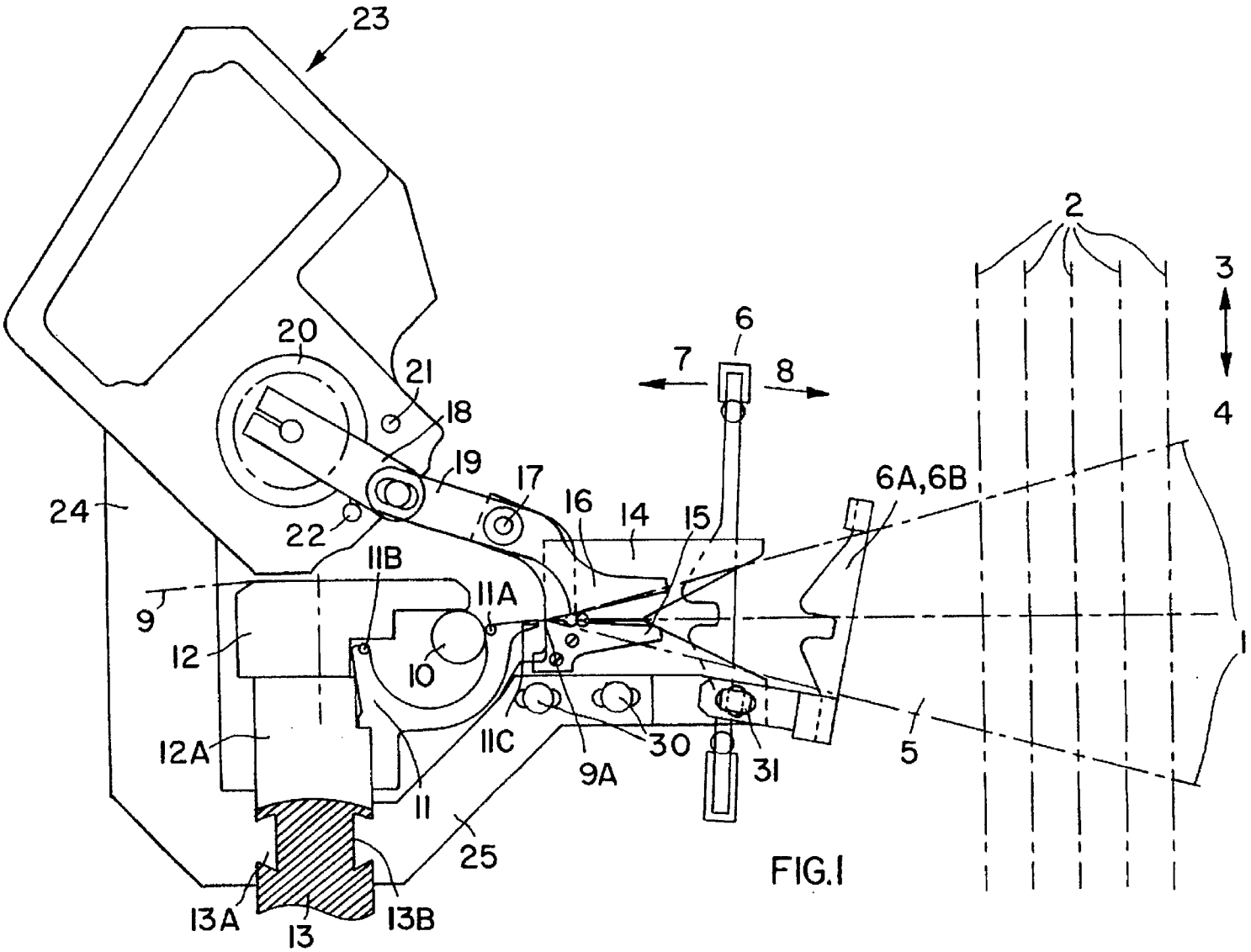
FIG. 1 is a schematic side view of a first embodiment of significant components of a loom according to the invention.
Figure 2:
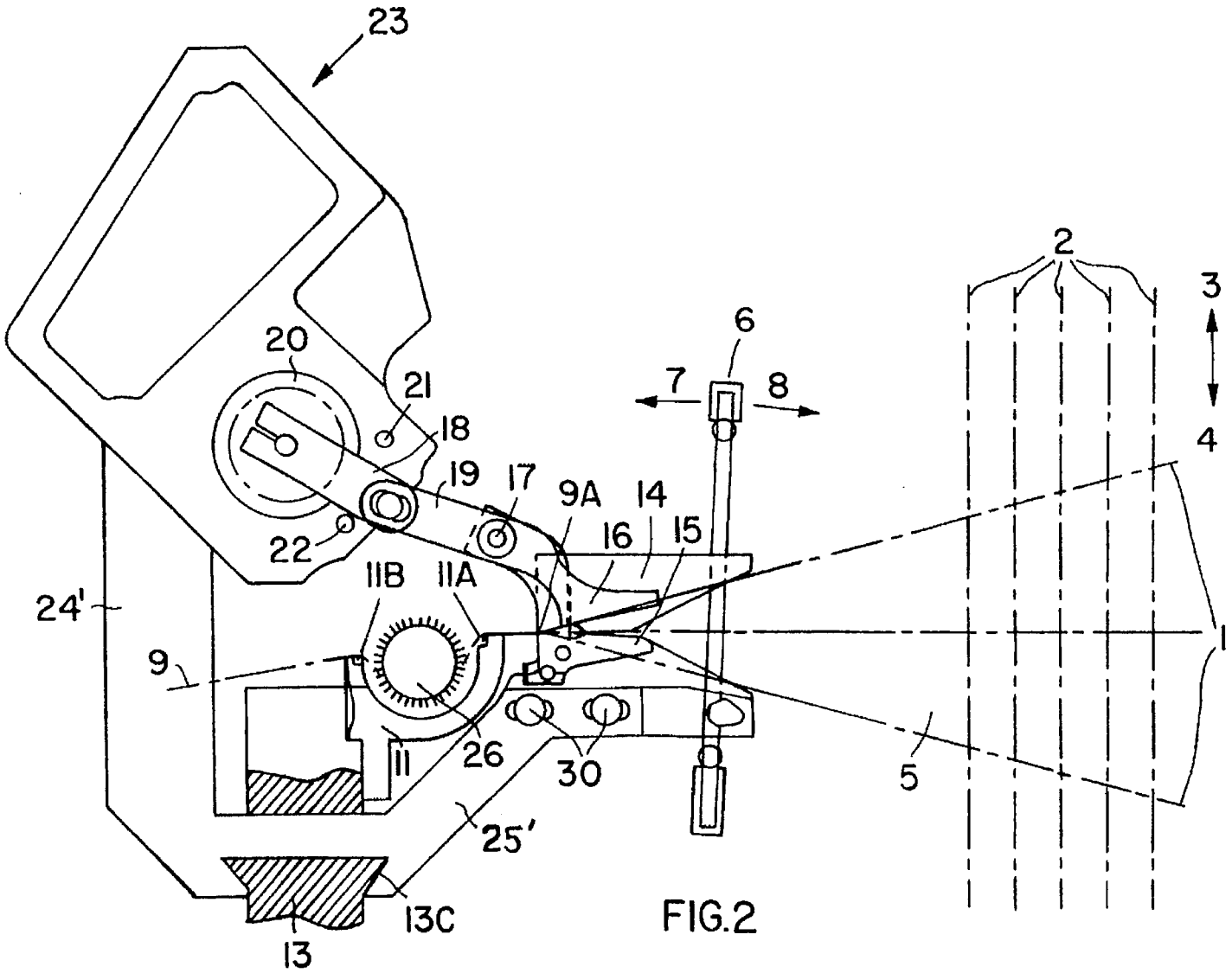
FIG. 2 is a side view similar to that of FIG. 1, but showing a second embodiment of a loom according to the invention.
Figure 3:
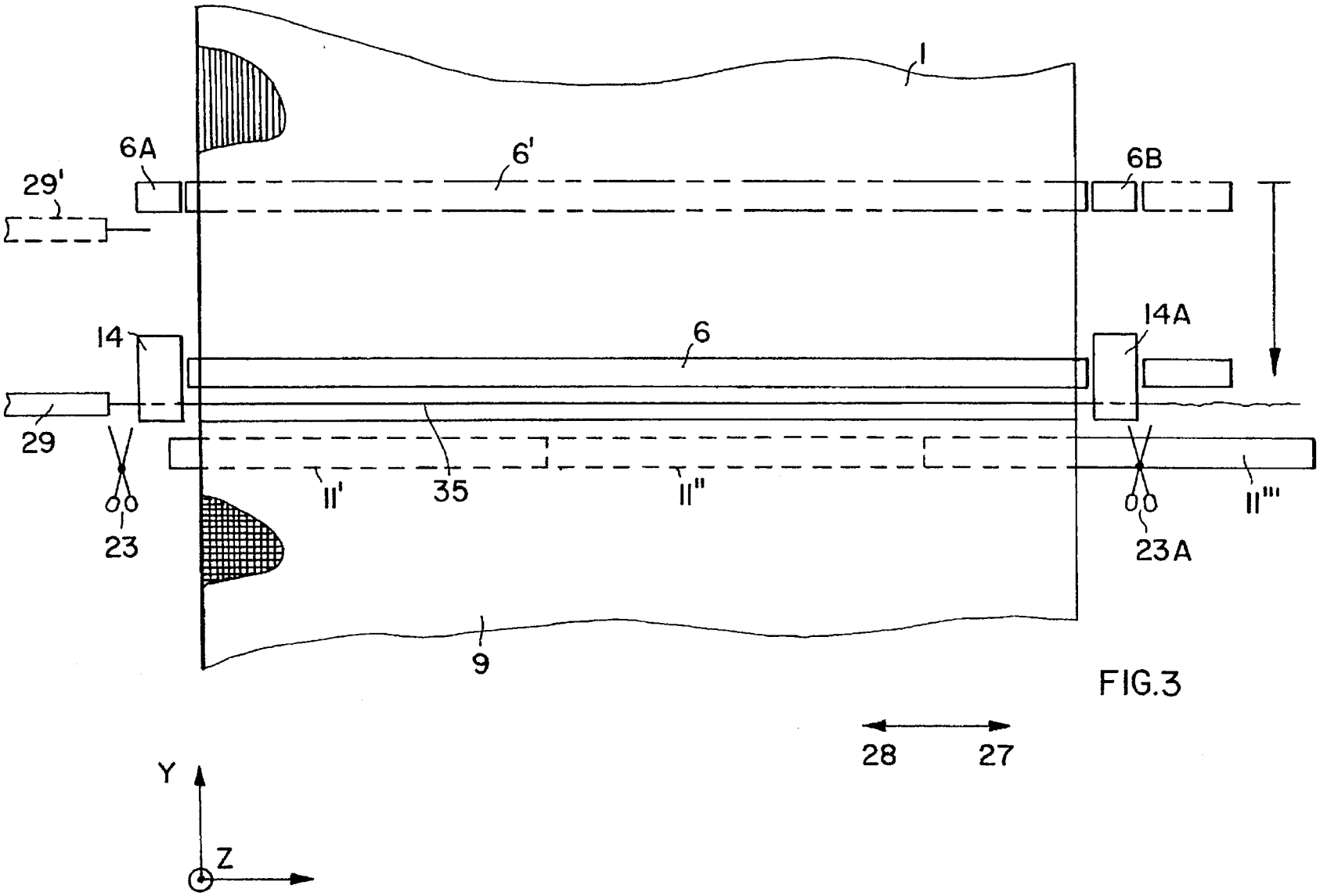
FIG. 3 is a schematic top view of the inventive arrangement of a loom according to the invention, for weaving a single fabric web.
Figure 4:
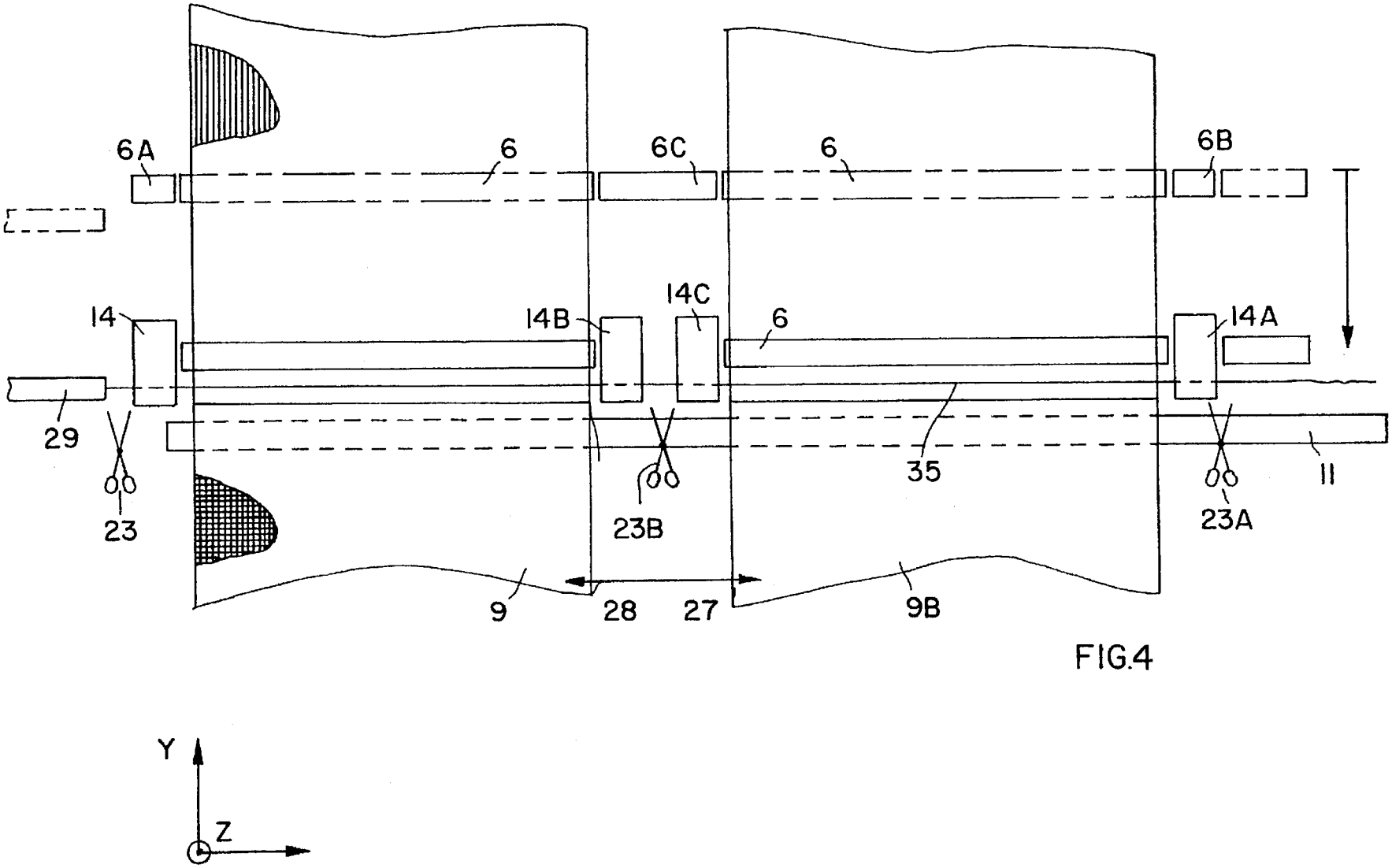
FIG. 4 is a schematic top view similar to that of FIG. 3, but showing a further embodiment of a loom according to the invention for simultaneously weaving two fabric webs.

FIGS. 1 and 2 respectively show two different example embodiments of the arrangement of components in a loom according to the present invention. Many of the components are the same in FIGS. 1 and 2, and are correspondingly identified with the same reference numbers. Thus, the following description can be understood to apply to both FIGS. 1 and 2 wherever applicable. Warp threads 1 are let off from a warp beam that is not shown, and pass through the respective heald frames or shafts 2, which are moveable up and down in directions 3 and 4, to respectively lift and lower selected ones of the warp threads 1 to form the substantially triangular loom shed 5. A weft thread 35 is inserted into the loom shed 5 in a direction perpendicular to the drawing plane of FIGS. 1 and 2. The weft pick or insertion can be carried out by generally known air-jet nozzles, grippers, rapiers or the like. In the present example embodiment according to FIG. 1, the weft insertion is carried by an air-jet nozzle 29 and according to FIG. 2, the weft insertion is carried out by grippers. For the sake of clarity, the weft thread 35, the nozzle 29 and the grippers are not shown in FIGS. 1 and 2. In FIGS. 3 and 4 are shown the weft thread 35 and the nozzle 29.

The weft thread insertion is carried out when the tiltably arranged weaving reed 6 has been moved back in the direction of arrow 8 into its retracted or rear position (to the right in FIGS. 1 and 2). When the reed 6 is in its retracted back position, it is substantially aligned with auxiliary reed members 6A and 6B arranged at or near the ends of the reed 6 (see e.g. FIG. 3). After the weft thread insertion, the weaving reed 6 is tilted forwards, i.e. in the direction of arrow 7, to beat the weft thread 35 up against the binding point or beat-up point 9A of the woven fabric web 9. Next, while the weaving reed 6 is again retracted in the direction of arrow 8 into the starting position of the reed 6 and the heald frames 2 carry out a shed reversal or change of shed, the cutting device 23 cuts the weft thread 35 and the laying-in device 14 inserts the cut off end of the thread into the next shed 5 that has been formed.

As further shown in FIGS. 1 and 2, the cutting device 23 essentially comprises a fixed blade 15 and a movable blade 16 that is connected by a pivot joint 17 to the fixed blade 15. In the present example embodiment, the fixed blade 15 is rigidly connected to the laying-in device 14 or a supporting bracket 25 of the laying-in device as discussed below. The cutting device 23 further comprises a drive motor 20 provided with a driven lever arm 18. A linkage arm 19 is articulately connected to the driven arm 18 and is also connected by pivot joint 17 to the moveable blade 16. In order to carry out the cutting of the weft thread, the driven arm 18 pivots or swings back and forth between two stop members 21 and 22, and the motion of the arm 18 is transmitted through the linkage arm 19 to the moving blade 16, which thereby cuts the weft thread between the moving blade 16 and the fixed blade 15. The laying in device 14 may be any generally known laying-in device, and is preferably a pneumatic or air jet laying-in device, which is generally known as such.

Also generally in common to both FIGS. 1 and 2, a machine frame member forms a supporting rail member 13 for supporting the spreader table 11, the laying-in device 14 and the cutting device 23 as follows. The spreader table 11 is rigidly attached to the rail member 13. The laying-in device 14 is connected to supporting bracket 25 by an adjustable connecting fixture 30, that may be any known finely adjustable connection fixture, for example including adjustable bolts or studs arranged to be selectively fixable in elongated, slotted holes. The supporting bracket 25 in turn is slidably adjustably connected to the support rail member 13, for example with a dove-tail groove or rail. Similarly, the entire cutting device 23 is mounted on a supporting bracket 24, which in turn is slidably adjustably connected to the support rail member 13, for example with a dove-tail groove or rail. As an alternative, the two brackets 24 and 25 may be slidably mounted on two separate supporting rail members.

In order to achieve a low total mass of the weaving reed 6 in air-jet looms, preferably the auxiliary reed 6A is rigidly connected to the supporting bracket 25, or alternatively to the laying-in device 14. The connection of the auxiliary reed 6A to the bracket 25 may also be carried out with any known adjustable connecting element 31.

One distinction between the embodiments of FIGS. 1 and 2 relates to the particular mounting of the brackets 24 and 25 on the support rail member 13. Specifically, in FIG. 1 the brackets 24 and 25 are independent from each other. Support bracket 24 is slidingly received in a first dove-tail slot or groove 13A extending along the length of the rail member 13, so that the position of the cutting device 23 across the width of the loom can be adjusted by sliding the support bracket 24 to the desired position in the dove-tail groove 13A and then fixing the support bracket 24 at the desired position in any conventional or known manner that would be apparent to a person of ordinary skill, for example with a set screw that is screwed into the bracket 24 to bear against the rail member 13. Similarly, the support bracket 25 carrying the laying-in device 14 is slidingly received in a second dove-tail groove 13B that also extends along the rail member 13. Thus, the cutting device 23 and the laying-in device 14 are each independently adjustable to any desired position relative to the edge of the woven fabric web and relative to each other in the direction of the weaving width, i.e. perpendicularly to the plane of FIG. 1.

In the embodiment shown in FIG. 2, the cutting device 23 and the laying-in device 14 are both mounted on a common support member or bracket that includes the bracket arm 24' and the bracket arm 25'. The common support bracket 24', 25' is slidably adjustable and selectively fixable on a dove-tail rail 13C of the rail member 13 that extends in the width-wise direction of the machine. In this embodiment, the cutting device 23 and laying-in device 14 may be adjusted to a desired width-wise position in common or in unison with each other, while the relative position of the cutting device 23 to the laying-in device 14 remains fixed.

Another difference between the embodiments of FIGS. 1 and 2 relates to the spreader arrangement. In FIG. 1, the finished woven fabric web 9 is drawn off over a spreader table 11, a spreader rod 10 and a spreader cover 12. The spreader cover 12 is connected by a supporting post 12A to the rail member 13 that is fixed to the rest of the machine frame. The spreader table 11 includes a protruding lip edge 11C that protrudes upstream toward the beat-up point.

The embodiment of FIG. 2 does not use a spreader table 11 in conjunction with a spreader rod 10 and a spreader cover 12, but rather uses a needle spreader 26 instead of the spreader rod 10 and the spreader cover 12. As shown in FIG. 2, the finished woven fabric web 9 is guided over two spreader members 11A and 11B that are provided on the spreader table 11. The needle spreader 26 is arranged between the two spreader members 11A and 11B to grip or engage and thus guide the woven fabric web 9 between the two members 11A and 11B. The spreader table 11 of FIG. 2 does not include the upstream protruding lip edge 11C and the auxiliary reeds 6A, 6B described above. The lip edge 11C is omitted in looms with a gripper-type weft insertion.

FIG. 3 is a schematic top view of the inventive arrangement in an air-jet loom. A weft thread insertion device 29, such as a weft thread insertion nozzle or a weft thread gripper, is arranged at the left edge of the fabric web 9, or more specifically at the left edge of the weaving reed 6. When the weaving reed 6 is in its rear or retracted position as shown by dashed lines at 6', the insertion device shown by dashed lines at 29' shoots the weft thread across the width of the open loom shed, namely first crossing the fixed auxiliary reed 6A, then the primary reed 6 and then the fixed auxiliary reed 6B on the right side. Then the reed 6 carries out a beat-up motion while the auxiliary reeds 6A and 6B remain in their fixed locations. When the reed 6 is in its rear or retracted position at 6', the auxiliary reeds 6A and 6B fill gaps in the reed 6 that are provided to accommodate the laying-in devices 14 and 14A when the reed 6 beats up the weft thread against the binding edge. Once the weft thread 35 has been beaten up, the two ends of the thread are cut off by cutting devices 23 and 23A as discussed above. In FIG. 3 the cutting devices 23 and 23A are simply shown schematically as stylized scissors. FIG. 3 shows the spreader table 11 made up of three segments 11', 11", and 11'", in comparison to the one-piece spreader table of FIG. 4. Any of the present embodiments may use a one-piece or a multi-piece table.

In order to allow the components to be converted to a different weaving width, at least the right laying-in device 14A and the associated cutting device 23A are arranged to be slidably adjustable in the width-wise directions 27, 28 in the manner discussed above. Thus, the laying-in device 14A and the cutting device 23A may be independently adjustable according to the embodiment of FIG. 1 or may be adjustable in common and in unison in the embodiment of FIG. 2. Preferably, the fixed auxiliary reed 6B is connected to the support bracket 25 that carries the laying-in device 14A, or on some other associated component of the laying-in device 14A, as shown in FIG. 1 and discussed above. Thus, the auxiliary reed 6B will be automatically adjusted to the proper width position simply by adjusting the laying-in device 14A. Furthermore, as described above with reference to FIG. 2, the laying-in device 14A and the cutting device 23A can also be joined to form a single structural component mounted on a common supporting bracket, so that all the components 14A and 23A are adjusted in common and in unison. If it is desired, the left laying-in device 14 and cutting device 23 can also be embodied in a position-adjustable manner as described above.

FIG. 4 shows a further alternative embodiment in which two woven fabric webs 9 and 9B are produced simultaneously next to one another on the air-jet loom. In this embodiment, it is simply necessary to provide a single cutting device 23B that cuts and prepares the weft thread ends for the associated laying-in devices 14B and 14C for the adjacent selvage edges of the two fabric webs. Thus, the cutting device 23B, the two laying-in devices 14B and 14C, and an associated auxiliary reed 6C are all arranged between the two fabric webs 9 and 9B.

An advantage of the embodiment shown in FIG. 4 is that the same configuration or type of laying-in device can be used for the two respective right-hand edges of the two fabric webs and similarly the same laying-in device can be used for the two respective left edges of the two fabric webs. In other words, laying-in devices 14 and 14C can be identical to one another and the laying-in devices 14A and 14B can be identical to one another.

In order to allow the loom components to be adjusted to different weaving widths, at least two sets comprising a cutting device, a laying-in device, and an auxiliary reed should be embodied in an adjustable manner as described above. For example, the right side laying-in device 14A as well as the two central laying-in devices 14B and 14C can be arranged to be adjustable in the width-wise directions 27 and 28 relative to one another and relative to the width of the loom, i.e. to be moveable across the entire width of the loom. The two laying-in devices 14B and 14C as well as the cutting device 23B and the auxiliary reed 6C can be arranged to be adjustable relative to each other or to be fixed relative to each other. Alternatively, the central cutting device 23B, laying-in devices 14B and 14C and auxiliary reed 6C can be arranged in a stationary or fixed manner, while the component set comprising the cutting device 23, the laying-in device 14 and the auxiliary reed 6A and the component set comprising the cutting device 23A, the laying-in device 14A and the auxiliary reed 6B are each arranged in a position adjustable manner according to any of the above described embodiments. As a further alternative, all of the cutting devices, laying-in devices, and auxiliary reeds can be arranged in a position-adjustable manner.

The above described embodiments provide a coarse position adjustment as well as a fine position adjustment for each laying-in device 14, 14A, 14B and 14C and for each cutting device 23, 23A and 23B. The adjustments can be carried out in the X, Y and Z directions, and may be adjustments of the components relative to the loom machine frame and of the components relative to each other. For example, the coarse position adjustment is preferably carried out in that the respective support brackets 24 and 25 or a common support bracket including support arms 24' and 25' is moved along dove-tail guides 13A, 13B or 13C of the machine frame member 13 and then fixed at the desired position. To carry out the fine adjustment, the various components can be mounted on the support brackets 24, 25, 24' or 25' by generally known adjustable connecting fixtures, for example using adjustable bolts 30 securing the laying-in device 14 to the support bracket 25 as discussed above. These fine adjustment elements 30 allow the position of the associated component to be finely adjusted in X, Y and Z directions as is generally known.

The present invention thus makes it possible to produce woven fabric webs of different widths on the same loom without requiring a complex and time consuming adjustment or refitting procedure when switching from one weaving width to a different weaving width, and without requiring the exchange of spreader tables with the associated spreader devices for switching to a different weaving width. Moreover, the invention makes it possible to form laid-in selvages exactly as desired along the edges of fabric webs of substantially any width using the same loom and the same selvage forming components.

Although the invention has been described with reference to specific example embodiments, it will be appreciated that it is intended to cover all modifications and equivalents within the scope of the appended claims.

What is claimed is:

1. A weaving loom having a nominal maximum weaving width for producing at one time at least one woven fabric web that has at least one laid-in selvage and has a selected adjustable web width less than or equal to said nominal maximum weaving width, said loom comprising a weft thread cutting device, a selvage-forming thread laying-in device, a fabric spreader table extending across said nominal maximum weaving width, at least one fabric spreader device arranged along said fabric spreader table, at least one support rail member extending substantially parallel to said spreader table at least across said web width, and adjustable connector means adjustably connecting said cutting device and said laying-in device to said at least one support member so that said cutting device and said laying-in device are selectively positionable along said spreader table at least across said web width to a selected position for forming said laid-in selvage.

2. The loom of claim 1, wherein said adjustable connector means comprise a first support bracket connecting said cutting device to said at least one support rail member, and a second support bracket connecting said laying-in device to said at least one support rail member, wherein said first and second support brackets are arranged translationally slidable along said at least one support rail member, and wherein at least either said first support bracket or said second support bracket includes a finely adjustable connection fixture so that said laying-in device is position adjustable relative to said cutting device.

3. The loom of claim 2, comprising only one said support rail member, wherein said first support bracket and said second support bracket are both mounted on said one support rail member to be translationally slidable thereal-ong.

4. The loom of claim 3, wherein said first support bracket and said second support bracket reach around said spreader table from opposite sides so that said cutting device is arranged above and upstream of said spreader table and said spreader device, and so that said laying-in device is arranged below and upstream of said spreader table and said spreader device.

5. The loom of claim 2, wherein said first support bracket and said second support bracket are interconnected to form a single structural component including said brackets, said cutting device and said laying-in device, wherein said single structural component is movably mounted on said at least one support rail member go that said cutting device and said laying-in device are selectively positionable in unison along said spreader table.

6. The loom of claim 2, wherein said first support bracket and said second support bracket are independent from each other, and are independently movably mounted on said at least one support rail member so that said cutting device and said laying-in device are each independently selectively positionable along said spreader table.

7. The loom of claim 2, wherein said cutting device comprises a fixed cutting blade, a movable cutting blade, and a drive linkage connected to said movable cutting blade.

8. The loom of claim 7, wherein said fixed cutting blade, said laying-in device and said second support bracket are interconnected in a fixed manner.

9. The loom of claim 8, wherein said laying-in device is secured to said fixed cutting blade.

10. The loom of claim 2, wherein said loom is an air jet loom, further comprising a movable main reed and a fixed auxiliary reed, wherein said auxiliary reed is fixedly attached to at least one of said laying-in device and said second support bracket.

11. The loom of claim 2, wherein said at least one support rail member has a dove-tail guide groove therein extending in a lengthwise direction thereof, and wherein said first support bracket and said second support bracket are each respectively slidably engaged with said dove-tail guide groove.

12. The loom of claim 1, wherein said spreader device comprises a spreader rod and a spreader cover.

13. The loom of claim 1, wherein said spreader device comprises two spreader members and a needling spreader arranged between said spreader members.

14. The loom of claim 1, wherein said spreader table is a one-piece component.

15. The loom of claim 1, wherein said spreader table comprises a lip edge protruding upstream toward said cutting device and said laying-in device.

16. The loom of claim 1, further comprising a gripper-type weft insertion device, wherein said spreader table comprises a plurality of table sections assembled together to extend across said nominal maximum weaving width, and said spreader table does not include a lip edge protruding upstream therefrom.

17. The loom of claim 1, adapted to produce a plurality of said woven fabric webs at one time, wherein the loom comprises a plurality of said cutting devices and a plurality of said laying-in devices.

18. The loom of claim 17, wherein two of said laying-in devices forming a pair including a left-selvage laying-in device and a right-selvage laying-in device are arranged at a position adapted to be between two adjacent ones of said woven fabric webs, and a single one of said cutting devices is arranged between said two laying-in devices to cooperate with both of said two laying-in devices.

19. The loom of claim 1, wherein said laying-in device is a pneumatic laying-in device.

20. A weaving loom having a nominal maximum weaving width for producing at one time at least one woven fabric web that has at least one laid-in selvage and has a selected adjustable web width less than or equal to said nominal maximum weaving width, said loom comprising a weft thread cutting device, a selvage-forming thread laying-in device, a fabric spreader table extending across said nominal maximum weaving width; at least one fabric spreader device arranged along said fabric spreader table, and at least one support rail member extending substantially parallel to said spreader table at least across said web width, wherein said cutting device and said laying-in device are slidably mounted on said at least one support rail member to be selectively positionable therealong.

* * * * *

UNITED STATES PATENT AND TRADEMARK OFFICE
CERTIFICATE OF CORRECTION

PATENT NO. : 5,649,570

DATED : July 22, 1997

INVENTOR(S) : Wahhoud et al.

It is certified that error appears in the above-identified patent and that said Letters Patent is hereby corrected as shown below:

In Col. 8, line 27 (Claim 5), replace "go" by --so--.

Signed and Sealed this

Seventh Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,649,570 C1
DATED : July 22, 1997
INVENTOR(S) : Wahhoud et al.

It is certified that error appears in the above-identified patent and that said Letters Patent is hereby corrected as shown below:

Column 8,
Line 27, replace "go" by -- so --.
Line 36, insert claim 7 as follows:

7. The loom of claim 2, wherein said cutting device comprises a fixed cutting blade, a movable cutting blade, and a drive linkage connected to said movable cutting blade. --

Signed and Sealed this

Eleventh Day of June, 2002

*Attest:*

*Attesting Officer*

JAMES E. ROGAN
*Director of the United States Patent and Trademark Office*

US005649570B1

(12) REEXAMINATION CERTIFICATE (4416th)

United States Patent

Wahhoud et al.

(10) Number: US 5,649,570 C1

(45) Certificate Issued: Aug. 14, 2001

(54) WEAVING LOOM WITH A COMBINATION OF A WEFT THREAD CUTTING DEVICE AND A SELVAGE LAYING-IN DEVICE

(75) Inventors: Adnan Wahhoud, Lindau-Bodolz; Peter Czura, Wangen, both of (DE)

(73) Assignee: Lindauer Dornier Gesellschaft mbH, Lindau (DE)

Reexamination Request:
No. 90/005,632, Feb. 5, 2000

Reexamination Certificate for:

| | |
|---|---|
| Patent No.: | **5,649,570** |
| Issued: | **Jul. 22, 1997** |
| Appl. No.: | **08/570,671** |
| Filed: | **Dec. 11, 1995** |

Certificate of Correction issued Oct. 7, 1997.

(30) Foreign Application Priority Data

Dec. 9, 1994 (DE) ..... 44 43 899

(51) Int. Cl.[7] ..... D03D 47/48

(52) U.S. Cl. ..... 139/291 C; 139/188 R; 139/192; 139/291 R; 139/434

(58) Field of Search ..... 139/188 R, 192, 139/291 R, 291 C, 430, 434

(56) References Cited

U.S. PATENT DOCUMENTS

| | | |
|---|---|---|
| 3,563,280 | 2/1971 | Cugini . |
| 3,951,177 | 4/1976 | Santucci . |
| 4,905,740 | 3/1990 | Verclyte . |
| 4,951,717 | 8/1990 | Riezler . |
| 4,957,144 | 9/1990 | Watanabe et al. . |
| 4,984,608 | 1/1991 | Bertsch et al. . |
| 5,070,912 | 12/1991 | Ludwig . |

FOREIGN PATENT DOCUMENTS 0291744 11/1988 (EP) .

*Primary Examiner*—John J. Calvert

(57) ABSTRACT

A weaving loom for producing at least one woven fabric web (9) with at least one laid-in selvage includes a weft thread cutting device (23) and an associated selvage laying-in device (14). The cutting device and the laying-in device are mounted relative to the loom machine frame so as to be adjustably movable across the width of the loom along a spreader table (11) with its associated spreader devices (10, 12, 26) and then selectively fixed at any desired width-wise position. The cutting device and the associated laying-in device can be arranged to be independently adjustable, or can be mounted on a common support member, so as to be adjustable in common or in unison with each other across the width of the loom.

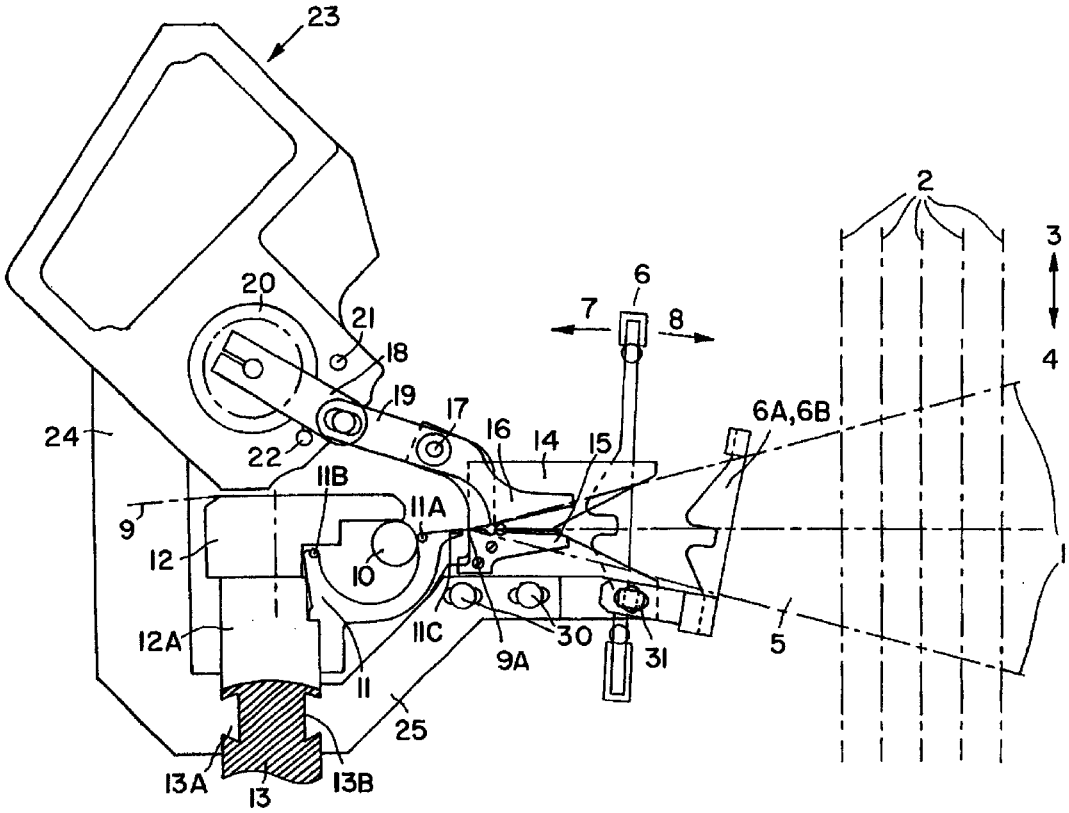

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, paragraph 4:

*Independently of the type of mounting of the supporting brackets 24, 24' and 25, 25' to two support rail members or to one support rail member 13, the supporting brackets 24, 24' and 25, 25' project from the support rail member 13 in a direction extending away from the support rail member 13 as best seen in FIGS. 1 and 2.*

AS A RESULT OF REEXAMINATION, IT HAS BEEN DETERMINED THAT:

Claims 1, 19 and 20 are cancelled.

Claims 2–6 and 8–18 are determined to be patentable as amended.

Claim 7, dependent on an amended claim, is determined to be patentable.

New claims 21–55 are added and determined to be patentable.

2. [The loom of claim 1] *A weaving loom having a nominal maximum weaving width for producing at one time at least one woven fabric web that has at least one laid-in selvage and has a selected adjustable web width less than or equal to said nominal maximum weaving width, said loom comprising a weft thread cutting device, a selvage-forming pneumatic thread laying-in device, a fabric spreader table extending across said nominal maximum weaving width, at least one fabric spreader device arranged along said fabric spreader table, at least one support rail member extending substantially parallel to said spreader table at least across said web width, and adjustable connector means adjustably connecting said cutting device and said pneumatic thread laying-in device to said at least one support rail member so that said cutting device and said pneumatic thread laying-in device are selectively positionable along said spreader table at least across said web width to a selected position for forming said laid-in selvage*, wherein said adjustable connector means comprise a first support bracket connecting said cutting device to said at least one support rail member, and a second support bracket connecting said *pneumatic thread* laying-in device to said at least one support rail member, wherein said first and second support brackets are arranged translationally slidable along said at least one support rail member, and wherein [at least either said first support bracket or said second support bracket includes a finely adjustable connection fixture so that said laying-in device is position adjustable relative to said cutting device] *said first and second support brackets are projecting from said at least one support rail member in a direction extending away from said at least one support rail member.*

3. The loom of claim 2, comprising only one said support rail member, wherein said first *projecting* support bracket and said second *projecting* support bracket are both mounted on said one support rail member to be translationally slidable therealong.

4. The loom of claim 3, wherein said first *projecting* support bracket and said second *projecting* support bracket reach around said spreader table from opposite sides so that said cutting device is arranged above and upstream of said spreader table and said spreader device, and so that said *pneumatic thread* laying-in device is arranged below and upstream of said spreader table and said spreader device.

5. The loom of claim 2, wherein said first *projecting* support bracket and said second *projecting* support bracket are interconnected to form a single structural component including said *projecting* brackets, said cutting device and said *pneumatic thread* laying-in device, wherein said single structural component is movably mounted on said at least one support rail member so that said cutting device and said *pneumatic thread* laying-in device are selectively positionable in unison along said spreader table.

6. The loom of claim 2, wherein said first *projecting* support bracket and said second *projecting* support bracket are independent from each other, and are independently movably mounted on said at least one support rail member so that said cutting device and said *pneumatic thread* laying-in device are each independently selectively positionable along said spreader table.

8. The loom of claim 7, wherein said fixed cutting blade, said *pneumatic thread* laying-in device and said second support bracket are interconnected in a fixed manner.

9. The loom of claim 8, wherein said *pneumatic thread* laying-in device is secured to said fixed cutting blade.

10. The loom of claim 2, wherein said loom is an air jet loom, further comprising a movable main reed and a fixed auxiliary reed, wherein said auxiliary reed is fixedly attached to at least one of said *pneumatic thread* laying-in device and said second support bracket.

11. The loom of claim 2, wherein said at least one support rail member has a dove-tail guide groove therein extending in a lengthwise direction thereof, and wherein said first *projecting* support bracket and said second *projecting* support bracket are each respectively slidably engaged with said dove-tail guide groove.

12. The loom of claim [1] *2*, wherein said spreader device comprises a spreader rod and a spreader cover.

13. The loom of claim [1] *2*, wherein said spreader device comprises two spreader members and a needling spreader arranged between said spreader members.

14. The loom of claim [1] *2*, wherein said spreader table is a one-piece component.

15. The loom of claim [1] *2*, wherein said spreader table comprises a lip edge protruding upstream toward said cutting device and said laying-in device.

16. The loom of claim [1] *2*, further comprising a gripper-type weft insertion device, wherein said spreader table comprises a plurality of table sections assembled together to extend across said nominal maximum weaving width, and said spreader table does not include a lip edge protruding upstream therefrom.

17. The loom of claim [1] *2*, adapted to produce a plurality of said woven fabric webs at one time, wherein the loom comprises a plurality of said cutting devices and a plurality of said *pneumatic thread* laying-in devices.

18. The loom of claim 17, wherein two of said *pneumatic thread* laying-in devices forming a pair including a left-selvage *pneumatic thread* laying-in device and a right-selvage *pneumatic thread* laying-in device are arranged at a position adapted to be between two adjacent ones of said woven fabric webs, and a single one of said cutting devices is arranged between said two *pneumatic thread* laying-in devices to cooperate with both of said two *pneumatic thread* laying-in devices.

*21. The loom of claim 2, wherein said first projecting support bracket is connected to said second projecting support bracket and to said at least one support rail member.*

*22. A weaving loom having a nominal maximum weaving width for producing at one time at least one woven fabric web that has at least one laid-in selvage and has a selected adjustable web width less than or equal to said nominal maximum weaving width, said loom comprising:*

*A) a weft thread cutting device,*

*B) a selvage forming pneumatic thread laying-in device,*

*C) a fabric spreader table extending across said nominal maximum weaving width,*

*D) at least one fabric spreader device arranged along said fabric spreader table,*

*E) at least one support rail member extending substantially parallel to said spreader table at least across said web width, and*

*F) adjustable connector means adjustably connecting said cutting device and said selvage forming pneumatic thread laying-in device to said at least one support rail member so that said cutting device and said selvage forming pneumatic thread laying-in device are selectively positionable along said spreader table at least across said web width to a selected position for forming said laid-in selvage,*

*G) wherein said adjustable connector means comprise a first support bracket for said adjustably connecting of said cutting device, and a second support bracket for said adjustably connecting of said selvage forming pneumatic thread laying-in device,*

*H) wherein said first support bracket and said second support bracket are interconnected to form a single structural component translationally slidable along said at least one support rail member, so that said cutting device and said pneumatic thread laying-in device are selectively positionable in unison along said spreader table, and*

*I) wherein said first support bracket and said second support bracket reach around said spreader table.*

*23. The loom of claim 22, comprising only one said support rail member, wherein said first support bracket and said second support bracket are both mounted on said one support rail member to be translationally slidable thereal-ong.*

*24. The loom of claim 22, wherein said first support bracket and said second support bracket reach around said spreader table so that said cutting device and said pneumatic thread laying-in device are positioned upstream of said spreader table and upstream of said spreader device as viewed in a fabric advance direction.*

*25. The loom of claim 22, wherein said cutting device comprises a fixed cutting blade, a movable cutting blade, and a drive linkage connected to said movable cutting blade.*

*26. The loom of claim 25, wherein said fixed cutting blade, said pneumatic thread laying-in device and said second support bracket are interconnected in a fixed manner.*

*27. The loom of claim 25, wherein said pneumatic thread laying-in device is secured to said fixed cutting blade.*

*28. The loom of claim 22, wherein said loom is an air jet loom, comprising a movable main reed and a fixed auxiliary reed, wherein said auxiliary reed is fixedly attached to at least one of said pneumatic thread laying-in device and said second support bracket.*

*29. The loom of claim 22, wherein said at least one support rail member has a dove-tail guide groove therein extending in a lengthwise direction thereof, and wherein said first support bracket and said second support bracket are each respectively slidably engaged with said dove-tail guide groove.*

*30. The loom of claim 22, wherein said spreader device comprises a spreader rod and a spreader cover.*

*31. The loom of claim 22, wherein said spreader device comprises two spreader members and a needling spreader arranged between said spreader members.*

*32. The loom of claim 22, wherein said spreader table is a one-piece component.*

*33. The loom of claim 22, wherein said spreader table comprises a lip edge protruding upstream toward said cutting device and said pneumatic thread laying-in device.*

*34. The loom of claim 22, wherein said loom comprises a plurality of said cutting devices and a plurality of said pneumatic thread laying-in devices for producing a plurality of said woven fabric webs simultaneously.*

*35. The loom of claim 34, wherein two of said pneumatic thread laying-in devices forming a pair including a left-selvage pneumatic thread laying-in device and a right-selvage pneumatic thread laying-in device are arranged at a position adapted to be between two adjacent ones of said woven fabric webs, and a single one of said cutting devices is arranged between said two pneumatic thread laying-in devices to cooperate with both of said two pneumatic thread laying-in devices.*

*36. The loom of claim 22, further comprising a gripper-type weft insertion device, wherein said spreader table comprises a plurality of table sections assembled together to extend across said nominal maximum weaving width, and said spreader table does not include a lip edge protruding upstream therefrom.*

*37. A weaving loom having a nominal maximum weaving width for producing simultaneously at least one woven fabric web that has at least one laid-in selvage and has a selected adjustable web width less than or equal to said nominal maximum weaving width, said loom comprising:*

*A) a weft thread cutting device,*

*B) a selvage forming pneumatic thread laying-in device,*

*C) a fabric spreader table extending across said nominal maximum weaving width,*

*D) at least one fabric spreader device arranged along said fabric spreader table,*

*E) at least one support rail member extending substantially parallel to said spreader table at least across said web width, and*

*F) adjustable connector means adjustably connecting said cutting device and said selvage forming pneumatic thread laying-in device to said at least one support rail member so that said cutting device and said selvage forming pneumatic thread laying-in device are selectively positionable along said spreader table at least across said web width to a selected position for forming said laid-in selvage,*

*G) wherein said adjustable connector means comprise a first support bracket for said adjustably connecting of said cutting device, and a second support bracket for said adjustably connecting of said selvage forming pneumatic thread laying-in device,*

*H) wherein said first support bracket and said second support bracket are independent of each other and are*

*independently movably mounted on said at least one support rail member so that said cutting device and said pneumatic thread laying-in device are each independently selectively positionable along said spreader table, and*

*I) wherein said first support bracket and said second support bracket reach around said spreader table.*

*38. A weaving loom having a nominal maximum weaving width for producing at one time at least one woven fabric web that has at least one laid-in selvage and has a selected adjustable web width less than or equal to said nominal maximum weaving width, said loom comprising a weft thread cutting device, a selvage-forming pneumatic thread laying-in device, a fabric spreader table extending across said nominal maximum weaving width, at least one fabric spreader device arranged along said fabric spreader table, at least one support rail member extending substantially parallel to said spreader table at least across said web width, and adjustable connector means adjustably connecting said cutting device and said pneumatic thread laying-in device to said at least one support rail member so that said cutting device and said pneumatic thread laying-in device are selectively positionable along said spreader table at least across said web width to a selected position for forming said laid-in selvage, wherein said adjustable connector means adjustably connecting said cutting device and said laying-in device to said at least one support rail member comprise a first projecting support bracket and a second projecting support bracket, wherein said first projecting support bracket and said second projecting support bracket are interconnected to form a single structural component including said first and second projecting support brackets, said cutting device and said pneumatic thread laying-in device, wherein said single structural component is movably mounted on said at least one support rail member so that said weft thread cutting device and said pneumatic thread laying-in device are selectively positionable in unison along said spreader table.*

*39. The loom of claim 38, comprising only one said support rail member, and wherein said interconnected first and second projecting support brackets are both mounted on said one support rail member to be translationally slidable therealong in unison.*

*40. The loom of claim 38, wherein said first projecting support bracket and said second projecting support bracket reach around said spreader table so that said cutting device is arranged above and upstream of said spreader table and said spreader device, and so that said pneumatic thread laying-in device is arranged below and upstream of said spreader table and said spreader device.*

*41. The loom of claim 38, wherein said cutting device comprises a fixed cutting blade, a movable cutting blade, and a drive linkage connected to said movable cutting blade.*

*42. The loom of claim 41, wherein said fixed cutting blade, said pneumatic thread laying-in device and said second projecting support bracket are interconnected in a fixed manner.*

*43. The loom of claim 42, wherein said pneumatic thread laying-in device is secured to said fixed cutting blade.*

*44. The loom of claim 38, wherein said loom is an air jet loom further comprising a movable main reed and a fixed auxiliary reed, wherein said auxiliary reed is fixedly attached to at least one of said pneumatic thread laying-in device and said second projecting support bracket.*

*45. The loom of claim 38, wherein said at least one support rail member has a dove-tail guide groove therein extending in a lengthwise direction thereof, and wherein said first projecting support bracket and said second projecting support bracket are each respectively slidably engaged with said dove-tail guide groove.*

*46. The loom of claim 38, wherein said spreader device comprises a spreader rod and a spreader cover.*

*47. The loom of claim 38, wherein said spreader device comprises two spreader members and a needling spreader arranged between said spreader members.*

*48. The loom of claim 38, wherein said spreader table is a one-piece component.*

*49. The loom of claim 38, wherein said spreader table comprises a lip edge protruding upstream toward said cutting device and said laying-device.*

*50. The loom of claim 38, further comprising a gripper-type weft insertion device, wherein said spreader table comprises a plurality of table sections assembled together to extend across said nominal maximum weaving width, and said spreader table does not include a lip edge protruding upstream therefrom.*

*51. The loom of claim 38, wherein said first and second projecting support brackets reach around said spreader table to hold said cutting device and said pneumatic thread laying-in device upstream of said spreader table and said spreader device.*

*52. The loom of claim 38, wherein said first projecting support bracket or said second projecting support bracket comprises a finely adjustable connection fixture so that said pneumatic thread laying-in device is position adjustable relative to said weft thread cutting device.*

*53. The loom of claim 2, wherein said first projecting support bracket or said second projecting support bracket comprises a finely adjustable connection fixture so that said pneumatic thread laying-in device is position adjustable relative to said weft thread cutting device.*

*54. The loom of claim 22, wherein said first support bracket or said second support bracket comprises a finely adjustable connection fixture so that said pneumatic thread laying-in device is position adjustable relative to said weft thread cutting device.*

*55. The loom of claim 37, wherein said first support bracket or said second support bracket comprises a finely adjustable connection fixture so that said pneumatic thread laying-in device is position adjustable relative to said weft thread cutting device.*

* * * * *